US006250718B1

(12) United States Patent
Newhouse et al.

(10) Patent No.: US 6,250,718 B1
(45) **Date of Patent: *Jun. 26, 2001**

(54) SUPPORT MEMBER FOR A CHAIR BACK

(75) Inventors: Thomas J. Newhouse, Grand Rapids; Marc A. Gierz, Hudsonville, both of MI (US)

(73) Assignee: Herman Miller Inc., Zeeland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/519,783

(22) Filed: Mar. 7, 2000

Related U.S. Application Data

(63) Continuation of application No. 09/201,290, filed on Nov. 30, 1998, now Pat. No. 6,109,696, which is a continuation of application No. PCT/US97/09144, filed on May 30, 1997.

(60) Provisional application No. 60/019,383, filed on Jun. 5, 1996.

(51) Int. Cl.[7] ..... A47C 7/02

(52) U.S. Cl. ..... 297/452.1; 297/452.11; 297/452.14; 297/452.21; 297/452.23; 297/452.18; 297/452.31; 297/452.33; 297/452.36; 297/440.2; 297/448.2; 297/446.2; 297/440.21

(58) Field of Search ..... 297/452.1, 440.2, 297/440.21, 239, 452.18

(56) References Cited

U.S. PATENT DOCUMENTS

| | | | | |
|---|---|---|---|---|
| 1,205,541 | * | 11/1916 | Hoehn | 297/452.53 X |
| 2,281,902 | | 5/1942 | Witz | 297/440.21 X |
| 2,575,221 | | 11/1951 | Horner et al. | 297/440.21 X |
| 3,036,864 | | 5/1962 | Arai | 297/440.16 |
| 3,080,194 | * | 3/1963 | Rowland | 297/239 |
| 3,336,078 | * | 8/1967 | Haley | 297/352 X |
| 3,724,897 | * | 4/1973 | Falks et al. | 297/448.2 X |
| 4,305,617 | * | 12/1981 | Benoit | 297/440.21 X |
| 4,548,441 | * | 10/1985 | Ogg | 297/239 |
| 4,932,720 | | 6/1990 | Sherman | 297/448.21 X |
| 5,064,247 | * | 11/1991 | Clark et al. | 297/440.2 X |
| 5,269,589 | | 12/1993 | Brothers et al. | 297/440.21 X |
| 5,383,712 | | 1/1995 | Perry | 297/239 X |
| 5,697,673 | * | 12/1997 | Favaretto | 297/452.15 X |
| 6,109,696 | * | 8/2000 | Newhouse et al. | 297/452.1 |

FOREIGN PATENT DOCUMENTS

| | | | | |
|---|---|---|---|---|
| 2933113 | * | 2/1981 | (DE) | 297/440.2 |

* cited by examiner

*Primary Examiner*—Peter M. Cuomo
*Assistant Examiner*—Rodney B. White
(74) *Attorney, Agent, or Firm*—Brinks Hofer Gilson & Lione

(57) ABSTRACT

A chair including a seat, a support member, an outwardly extending projection and a chair back. A support member extends upward adjacent a rear portion of the seat. An outwardly extending projection is attached the support member. The chair back includes front, back, top and bottom surfaces. The chair back has a cavity opening downwardly toward the bottom surface and an aperture is the back surface. The aperture extends in a direction from the cavity to the back surface and communicates with the cavity. The top portion of the support member extends into the cavity and the projection extends into the aperture.

7 Claims, 3 Drawing Sheets

SUPPORT MEMBER FOR A CHAIR BACK

RELATED APPLICATIONS

This application is a continuation of application Ser. No. 09/201,290, filed Nov. 30, 1998, now U.S. Pat. No. 6,109,696, which is a continuation of PCT application No. PCT/US97/09144, filed May 30, 1997, identifying inventors Thomas J. Newhouse and Marc A. Gierz, which claims priority to provisional U.S. application Ser. No. 60,019,383, filed Jun. 5, 1996, in the names of the above-identified inventors.

BACKGROUND OF THE INVENTION

The present invention relates to chairs. More particularly, the present invention relates to an improved chair back and support structure for use with a wire rod type chair.

In auditoriums, schools, and various halls, it is often desired to provide additional seating on a temporary basis. While folding chairs have filled this need in the past, the set up and take down of these types of chairs can be relatively time consuming. In addition, the storage of this type of chair can be cumbersome. For example, a separate rack may be required to maintain the chairs in an upright position.

Stackable wire rod type chairs have overcome some of the problems associated with folding chairs. In particular, they can be readily stored in a convenient stacked form. In addition, they can be readily set up in rows for use and then restacked when not in use.

However, wire rod chairs can suffer certain drawbacks. First, the assembly of a wire rod chair can be somewhat complicated. Various fastening devices, such a screws or the like, have been required to secure the chair back to the chair base. In addition to adding to the complexity of the chair construction, these additional parts add to the cost of the chair. Second, the installation of the chair back over the wire rods forming the chair base has been troublesome. Obviously, the chair back should be securely attached to the wire rods. Yet, simply extending the chair back over the wire rods may be unsatisfactory because of the failure of the chair back to be adequately secured to the chair base. In addition, the load bearing rods can cause "whiting" of the chair back when in use. In particular, when a user sits on the chair, a force is applied to the chair back through the wire rods. As a result, the plastic chair back can become deformed and therefore, discolored.

Accordingly, there is a need for an improved chair construction that will overcome these problems.

SUMMARY OF THE INVENTION

This invention is directed to an improved chair construction that may be manufactured at low cost while providing a secure assembly of the chair back to the chair base. In addition, this invention is directed to an improved chair construction that reduces deformation or "whiting" of the chair back.

According to a first aspect of the present invention, a chair is provided including a support member, a projecting surface and a chair back. A support member having a top portion extends upward from a rear portion of the seat. A projecting surface is attached to the top portion of the support member. The chair back includes front, back, top and bottom surfaces. A cavity opens downwardly toward the bottom surface of the chair back. An aperture communicating with the cavity is located within one of the front and back surfaces of the chair back. The top portion of the support member extends into the cavity with the projecting surface extending into the aperture.

According to another aspect of the present invention, a chair is provided including a support member, an insert member and a chair back. A support member having a top portion extends upward from a rear portion of a seat. An insert member is connected to the top portion of the support member. The chair back includes a cavity formed in the lower portion thereof The cavity opens downwardly toward a bottom surface of the chair back. The top portion of the support member extends into the cavity with the insert being sized to securely mate within the cavity of the chair back.

As used herein, the term "support member" is intended to include various support structures in addition to the preferred embodiment shown in the Figures. In addition to the preferred embodiment where each "support member" includes three support elements, it is intended that this term also include chairs where either one or two support elements extend upward from the rear portion of the seat.

As used herein, the term "aperture" should be broadly interpreted so as to include physical configurations in addition to the preferred embodiment shown in the Figures. For example, the aperture could also be a "blind hole" that does not extend completely through the back surface of the chair back.

The invention, together with its further objects and attendant advantages, will be best understood by reference to the following detailed description taken in conjunction with the accompanying drawings.

DETAILED DESCRIPTION OF THE PREFERRED EMBODIMENTS

The invention is described with reference to the drawings in which like elements are referred to by like numerals.

Figure 1:
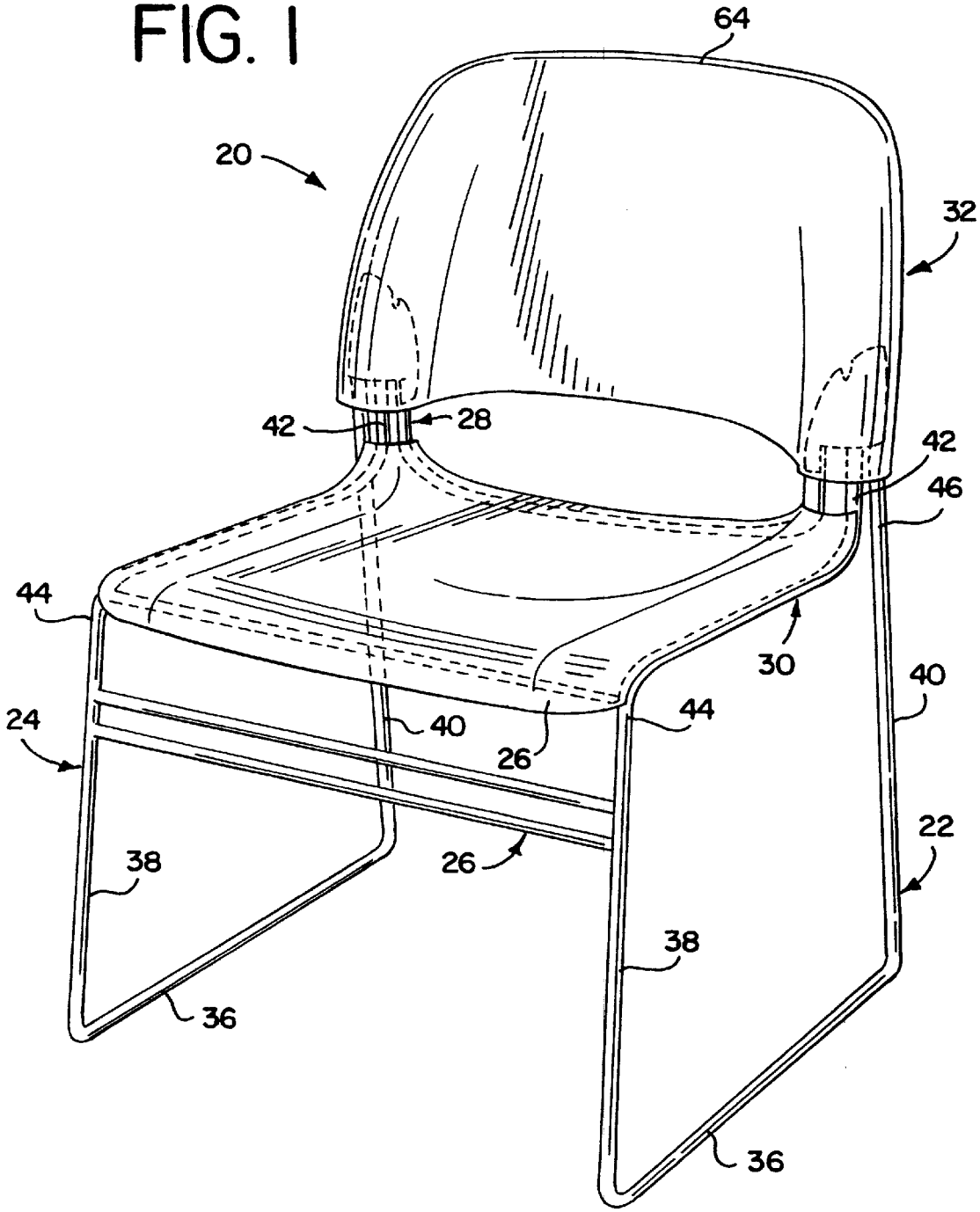
FIG. 1 is a front perspective view of a fully assembled chair illustrating the preferred embodiments of the present invention.

FIG. 1 illustrates a chair 20 in accordance with the preferred embodiments of the present invention. While a wire rod type chair is shown, it should be understood that the present invention can be used on various other types of chairs. The chair 20 includes a right side frame member 22 and a left side frame member 24. The frame members 22 and 24 are joined together in a substantially congruent, but spaced apart relation by front frame members 26 and a rear frame member 28. In a preferred embodiment, the front frame members 26 have a diameter of ⅜ inch with the other frame members having a diameter of 7/16 inch. As shown in FIG. 1, the chair 20 also includes a seat 30 and a chair back 32.

The frame members 22 and 24 include integral base members 36, front risers 38 and rear risers 40. Runners 42 extend from a top portion 44 of the front risers 38 horizontally back- to a position adjacent the top portion 46 of the rear risers 40. The seat 30 is secured between the runners 42. The front frame member 26 is secured between the front risers 38 by employing suitable welding techniques known to those of ordinary skill in the art. As will be better explained below, the rear frame member 28 is secured to the runners 42 and the rear risers 40. Therefore, in combination, the frame members 22, 24, 26, 28, the seat 30, and the chair back 32 substantially form the chair 20.

Figure 2:
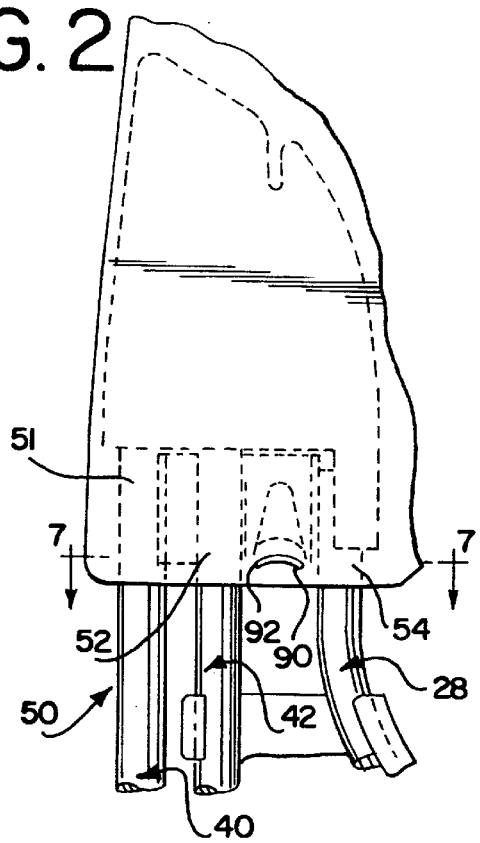
FIG. 2 is a rear fragmented view of the lower right side of the chair back with the support member, the support bracket, and the insert member being shown in dashed lines.
Figure 3:
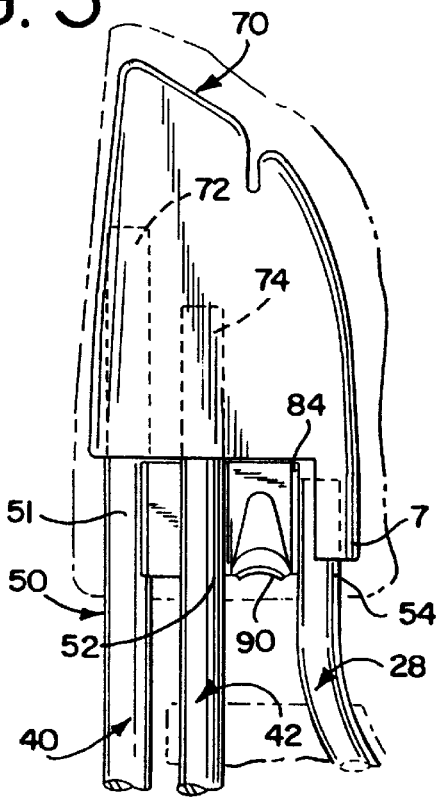
FIG. 3 is a rear fragmented view of the lower right side of the chair back with chair back shown in dashed lines in order to better show the support member, the support bracket, the projecting surface, and the insert member.
Figure 3:
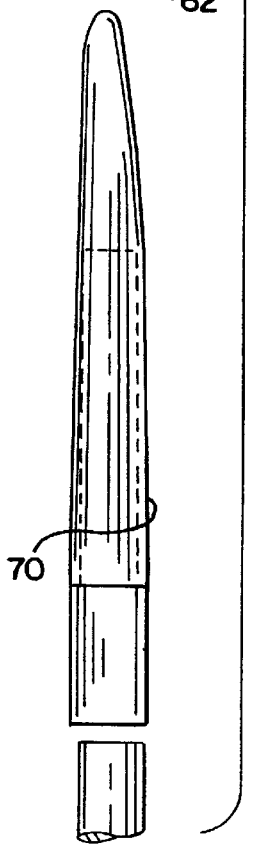

In the preferred embodiment, the rear risers 40, the runners 42 and the rear frame member 28 form support members 50 for the chair back 32. As shown in FIGS. 2–3 for the right hand side of the chair, the rear riser 40, the runner 42 and the rear frame member 28 include respective top portions 51, 52 and 54. With particular reference to FIG. 3, the rear riser 40 forms an outermost support element with the rear frame member 28 forming the innermost support element and the runner 42 being positioned therebetween.

Figure 4:
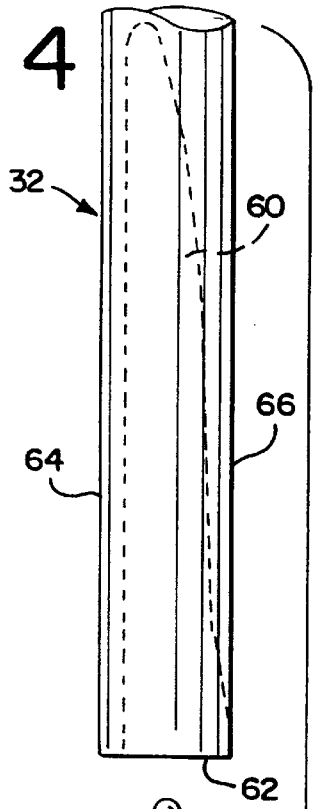
FIG. 4 is an exploded view of the chair back, the insert member and the support member.

As best seen in FIG. 4, the chair back 32 includes a cavity 60 in a lower portion thereof. The cavity 60 extends downward toward a bottom surface 62. In this manner, an upper portion of the chair back 32 can flexibly support a user. The chair back 32 also includes a front surface 64 and back surface 66.

Referring to FIGS. 3–6, an insert member 70 is attached to the top portions 51, 52 and 54 of the rear riser 40, the runner 42 and the rear frame member 28. The insert 70 is sized to securely mate with the inner walls that form the cavity 60 within the chair back 32. In this manner, the chair back 32 is securely attached to the support members 50.

Figure 5:
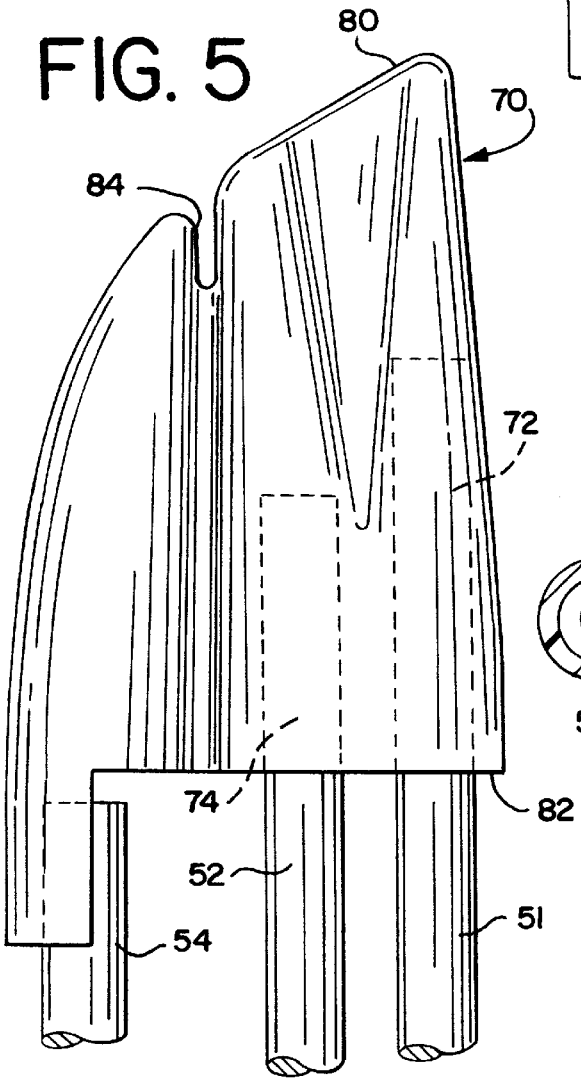
FIG. 5 is an assembled view of the support member and the insert member from the opposite perspective of that shown in FIGS. 2–3.
Figure 7:
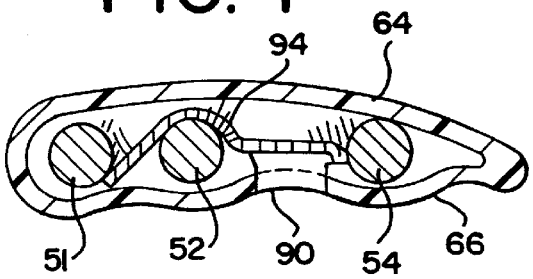
FIG. 7 is a cross-sectional view taken through the lines 7—7 of FIG. 2 in order to better show the support member, the projecting surface and the support bracket.

The insert member 70 includes a first cavity 72 and a second cavity 74. The cavities 72 and 74 form tubular openings in order to securely mate with the rear riser 40 and the runner 42. The first cavity 72 extends further into the insert 70 than the second cavity 74. In a preferred embodiment, the cavity 72 extends inward approximately 1 inch with the second cavity 74 extending inward approximately 0.3 inch. As shown in FIGS. 3 and 5, the top portion 51 of the rear riser 40 extends into and mates securely within the first cavity 72. In addition, the top portion 52 of the runner 42 extends into and mates securely within the second cavity 74. As also shown in these figures, a downwardly extending lip 75 mates with a part of the top portion 54 of the rear riser 28.

Figure 6:
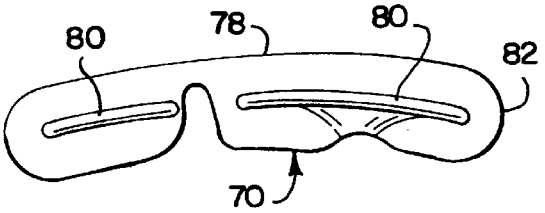
FIG. 6 is a top view of the insert member.
Figure 8:
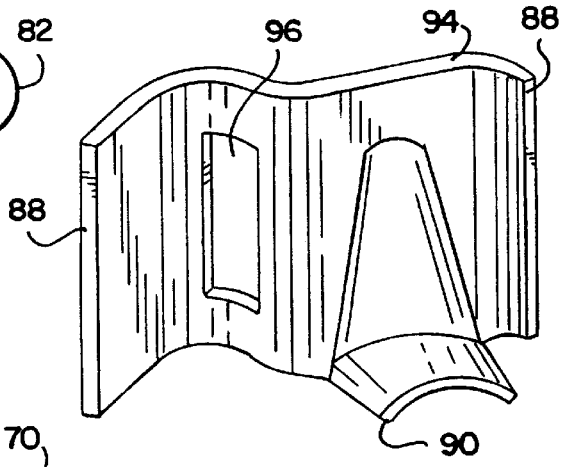
FIG. 8 is a front perspective view of the projecting surface and the support bracket.

As best seen in FIGS. 5 and 6, the insert 70 includes a curved outer surface 78 that corresponds with the curvature of the rear surface 66 of the chair back 32. The insert 70 tapers downward from a top surface 80 to a bottom surface 82. An opening 84 is formed in the top surface 80 in order to mate with a fin (not shown) formed in the top portion of the cavity 60. When these elements mate, the insert 70 is securely fitted within the cavity 60. In a preferred embodiment, the insert 70 has a height of approximately 4 inches, a width of approximately 2 inches, and a thickness of approximately ⅝ inch.

Referring to FIGS. 2–3 and 7–8, a projecting surface 90 extends through an aperture 92 formed in the back surface 66 of the chair back 32. The projecting surface 90 is integrally formed with a mounting bracket 94. With reference to FIG. 2, the bracket 94 is attached to side portions of the rear riser 40 and the rear frame member 28 and to a rear portion of the runner 42. In the preferred embodiment shown in FIG. 8, the bracket 94 includes an aperture 96 that may be filled with a flux material in order enhance welding of the bracket 94 to the runner 42. In addition, the bracket 94 is also preferably welded to the rear riser 40 and the rear frame member 28. As shown in FIGS. 2–3, the projecting surface 90 is curved to correspond with the curved aperture 92 in the back surface 66 of the chair back 32. As also shown in these figures, the projecting surface 90 extends between the runner 42 and the rear frame member 28.

Once assembled, the insert 70 is fixedly secured within the cavity 60 of the chair back 32. In addition, the projecting surface 90 extends through the aperture 92 in the back surface 66 of the chair back 32. Accordingly, the chair back 32 is thereby secured to the support members 50. Because the projecting surface 90 extends through the aperture 92, the personnel assembling the chair as well as the user, may clearly identify that the chair back 32 has been secured to the support members 50.

While the frame members of the present invention may be formed from various materials known to those of ordinary skill in the art, they are preferably formed from cold rolled steel. Similarly, while the seat 30, the chair back 32 and the insert 70 can also be formed in various known manners using various known materials, these elements are preferably injection molded from polypropylene.

Accordingly, the present invention provides an office chair construction that is less expensive to manufacture than previous constructions. In addition, the present invention is also easy to assemble by unskilled persons due to the simplified and improved chair back and support members.

The present invention may be embodied in other specific forms without departing from the spirit of the invention. For example, the aperture 92 could be located on the front surface 64 of the chair back 32 rather than on the rear surface 66 as shown in the drawings. Therefore, it is intended that the foregoing detailed description be regarded as illustrative rather than limiting, and it is understood that the appended claims, including all equivalents, are intended to define the scope of the invention.

We claim:

1. A chair including a seat comprising:

a support member extending upward adjacent a rear portion of said seat, said support member having a top portion;

an outwardly extending projection attached to said support member; and a chair back having front, back, top and bottom surfaces, said chair back having a cavity opening downwardly toward said bottom surface and an aperture within said back surface, said aperture extending in a direction from said cavity to said back surface and communicating with said cavity, said top portion of said support member extending into said cavity, and said projection extending into said aperture.

2. The chair of claim 1 wherein said seat and chair back are formed from two separate elements.

3. The chair of claim 2 wherein said chair includes two side frame members each having a front, base and rear portion.

4. The chair of claim 3 wherein each of said frame is formed as one piece.

5. The chair of claim 4 wherein said frame are connected by a front frame member.

6. The chair of claim 5 wherein said cavity includes an upper portion and lower portion, said aperture extending into the lower portion.

7. The chair of claim 6 wherein said chair includes a second cavity in said chair back and a second aperture extending in a direction from second cavity to said back surface and communicating with said second cavity, a top portion of another support member extending into said second cavity, and a second projection extending into said second aperture.

* * * * *